US006842732B2

(12) United States Patent
Miseki

(10) Patent No.: US 6,842,732 B2
(45) Date of Patent: Jan. 11, 2005

(54) SPEECH ENCODING AND DECODING METHOD AND ELECTRONIC APPARATUS FOR SYNTHESIZING SPEECH SIGNALS USING EXCITATION SIGNALS

(75) Inventor: Kimio Miseki, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 516 days.

(21) Appl. No.: 09/803,998

(22) Filed: Mar. 13, 2001

(65) Prior Publication Data

US 2002/0052745 A1 May 2, 2002

(30) Foreign Application Priority Data

Oct. 20, 2000 (JP) ..... 2000-320679

(51) Int. Cl.[7] ..... G10L 19/06

(52) U.S. Cl. ..... 704/223; 704/219; 704/220; 704/230

(58) Field of Search ..... 704/223, 219, 704/220, 230, 208, 222

(56) References Cited

U.S. PATENT DOCUMENTS

| | | | | |
|---|---|---|---|---|
| 5,950,155 A | * | 9/1999 | Nishiguchi | 704/230 |
| 6,041,297 A | * | 3/2000 | Goldberg | 704/219 |
| 6,202,046 B1 | * | 3/2001 | Oshikiri et al. | 704/233 |
| 6,233,550 B1 | * | 5/2001 | Gersho et al. | 704/208 |
| 6,240,382 B1 | * | 5/2001 | Lin | 704/219 |
| 6,311,154 B1 | * | 10/2001 | Gersho et al. | 704/219 |
| 6,704,702 B2 | * | 3/2004 | Oshikiri et al. | 704/207 |

FOREIGN PATENT DOCUMENTS

| | | |
|---|---|---|
| JP | 4-352199 | 12/1992 |
| JP | 10-149200 | 6/1998 |
| JP | 2000-122698 | 4/2000 |

OTHER PUBLICATIONS

Taniguchi et al., "Pitch Sharpening for Perceptually Improved CELP, and the Sparse–Delta Codebook for Reduced Computation", Speech Processing 1, International Conference on Acoustics, Speech, and Signal Processing, May 14–17, 1991, Toronto, Ontario, Canada, IEEE, vol. 1, pp. 241–244.

Kroon et al., "Strategies for Improving the Performance of CELP Coders at Low Bit Rates", IEEE, Apr. 11, 1988, pp. 151–154.

Wang et al., "Improved Excitation For Phonetically–Segmented VXC Speech Coding Below 4 KB/s", Globecom '90, IEEE Global Telecommunications Conference & Exhibition, San Diego, CA, Dec. 2–5, 1990, IEEE, vol. 2, Dec. 2, 1990, pp. 946–950.

Schroeder et al., "Code–Excited Linear Prediction (CELP): High–Quality Speech at Very Low Bit Rates," IEEE (1985), pp. 25.1.1–25.1.4.

* cited by examiner

*Primary Examiner*—Susan McFadden
(74) *Attorney, Agent, or Firm*—Finnegan, Henderson, Farabow, Garrett & Dunner, L.L.P.

(57) ABSTRACT

A speech encoding method of generating a synthesized speech signal by using an excitation signal generated by using an adaptive codebook storing a past excitation signal includes the steps of modifying an excitation signal used to generate a synthesized speech signal by filter processing, and storing the modified excitation signal in the adaptive codebook.

18 Claims, 3 Drawing Sheets

SPEECH ENCODING AND DECODING METHOD AND ELECTRONIC APPARATUS FOR SYNTHESIZING SPEECH SIGNALS USING EXCITATION SIGNALS

CROSS-REFERENCE TO RELATED APPLICATIONS

This application is based upon and claims the benefit of priority from the prior Japanese Patent Application No. 2000-320679, filed on Oct. 20, 2000; the entire contents of which are incorporated herein by reference.

BACKGROUND OF THE INVENTION

1. Field of the Invention

The present invention relates to a speech encoding method and speech decoding method which are used to compression-encode and decode speech signals, audio signals, and the like.

2. Description of the Background Art

As a method of compression-encoding speech signals, a CELP (Code-Excited Linear Prediction) scheme is known ("Code-Excited Linear Prediction (CELP): High-quality Speech at Very Low Rates "Rroc. ICASSP '85, 25, 1.1 pp. 937–940, 1985).

According to characteristic features of the CELP scheme, modeling of a speech signal is performed separately for a synthesis filter and an excitation signal for driving the synthesis filter, and distortion is evaluated in accordance with the level of a perceptually weighted speech signal in encoding the excitation signal, thereby making it difficult to perceive encoding distortion. A synthesized speech signal after encoding is generated by passing the excitation signal through the synthesis filter. The excitation signal is generated by combining two code vectors, i.e., an adaptive code vector generated from an adaptive codebook storing past excitation signals and a stochastic vector generated from a stochastic codebook.

An adaptive code vector mainly represents repetition of a waveform based on a pitch period as a feature of an excitation signal in a voiced speech interval. A stochastic code vector contains a component for compensating for a component contained in an excitation signal which cannot be expressed by an adaptive code vector, and is used to make a synthesized speech signal more natural.

An adaptive codebook is a codebook using the fact that a repeating waveform based on a pitch period of an excitation signal is similar to the repeating waveform of an immediately preceding excitation signal. More specifically, past excitation signals are stored in the adaptive codebook without any changes, and a past excitation signal is extracted from the adaptive codebook by an amount corresponding to a pitch period. The vector obtained by repeating the extracted signal with a pitch interval at a pitch period up to a signal interval is used as an adaptive code vector. As described above, according to the conventional adaptive codebook, the current adaptive code vector is obtained by directly repeating an excitation signal used in the past. In this conventional method, if the encoding bit rate is decreased to about 4 kbits/s, since an insufficient number of bits are assigned to express an excitation signal, distortion due to encoding is clearly perceived. As a consequence, the speech becomes unclear or noisy. That is, the sound quality considerably deteriorates. Demands have therefore arisen for a high-efficiency encoding scheme that can generate synthesized speech with high quality even if the bit rate is decreased.

As described above, in the conventional speech encoding method, it is difficult to obtain synthesized speech with high quality at a low bit rate.

It is an object of the present invention to provide a speech encoding method/speech decoding method which can generate synthesized speech with high quality even at a low bit rate.

BRIEF SUMMARY OF THE INVENTION

The present inventor has given special consideration to the fact that in pitch period components contained in a voiced speech signal, low frequency components exhibit repetition with a stronger correlation than high frequency components in terms of frequency. That is, pitch repetition components in a low frequency band tend to change slowly, whereas pitch repetition components in a high frequency band tend to change quickly.

In consideration of the characteristics of the pitch period components contained in the speech signal, therefore, the degree of contribution to a better expression of an excitation signal by an obtained adaptive code vector is generally higher on the low-frequency side than on the high-frequency side. That is, excitation signals in a low frequency band can be stored in an adaptive codebook and reused more effectively than excitation signals in a high frequency band. Therefore, the conventional method is not necessarily effective, in which excitation signals in all frequency bands are stored in an adaptive codebook in the same manner.

The present invention has been made in consideration of the general tendency that the contributions of adaptive code vectors in different frequency bands vary, and the contributions of adaptive code vectors decrease with an increase in frequency.

Synthesized speech with high quality can be obtained and excellent synthesized speech can be obtained even at a low bit rate by changing characteristics depending on such frequency bands, i.e., updating an adaptive codebook by using an excitation signal after modification by excitation filter processing (adjusting an output in accordance with a frequency band).

According to the present invention, there is provided a speech encoding method of generating a synthesized speech signal by using an excitation signal generated by using an adaptive codebook storing a past excitation signal, comprising modifying an excitation signal used to generate a synthesized speech signal by filtering, and storing the modified excitation signal in the adaptive codebook.

A speech encoding/decoding method is provided, which can synthesize speech with high quality by storing an excitation signal modified by predetermined filter processing in an adaptive codebook instead of storing an excitation signal in the adaptive codebook without any modification as in the conventional method.

As described above, since an adaptive code vector in a lower frequency band contributes more to an excitation signal, low-pass characteristics are preferably provided. An excitation signal can be generated by using a first code vector obtained from an adaptive codebook (first codebook) reflecting periodicity and a second code vector (e.g., a stochastic code vector) obtained from another kind of codebook (a second codebook, e.g., a stochastic codebook). However, the present invention is not limited to the stochastic codebook, and the number of codebooks used is not limited to two; an excitation signal can be obtained from a plurality of codebooks including an adaptive codebook.

For example, the present invention can be implemented by a speech encoding method of generating a synthesized speech signal by using an excitation signal generated by using a first code vector obtained from an adaptive codebook storing a past excitation signal and a second code vector obtained from a predetermined codebook (e.g., a stochastic codebook). This speech encoding method comprises selecting code information representing a first code vector by using the adaptive codebook so as to reduce perceptually weighted distortion between a target vector obtained from an input speech signal and a synthesized vector obtained by synthesizing candidate vectors of the first code vector; selecting code information representing a second code vector from the codebook so as to reduce perceptually weighted distortion of the synthesized speech signal; generating an excitation signal by using the selected first and second code vectors; modifying the generated excitation signal by filter processing; and storing the modified excitation signal in the adaptive codebook.

When an excitation signal is to be generated from an adaptive code vector obtained from an adaptive codebook and a stochastic code vector obtained from a stochastic codebook, an excitation signal before modification is given by, for example, an excitation vector u expressed by the following equation, and is input to a synthesis filter to obtain synthesized speech. Note that the excitation signal is not limited to this.

$$u=G0\times 0+G1\times 1$$

where u is an excitation vector, x0 is an adaptive code vector, x1 is a stochastic code vector, G0 is the gain of the adaptive code vector, and G1 is the gain of the stochastic code vector.

Filters with various conditions can be used for filter processing to be performed for this excitation signal before modification. For example, excitation filter processing is performed for the excitation signal before modification by using a recursive filter expressed by $R(z)=1/(1-klz^{-1})$ (k1: filter coefficient) in a z-transform domain, and the result is stored as latest data in the adaptive codebook.

The excitation vector modified by using such filter processing is given by $$v(n)=u(n)+klv(n-1)$$

where v is the modified excitation vector, u(n) is the current excitation signal, v(n) is the modified excitation signal, and k1 is a filter coefficient.

Note that this excitation filter is not limited to a single-order recursive filter, and a multi-order filter or non-recursive filter may be used.

In addition, characteristics of an excitation filter may change depending on encoding information (synthesis filter information, pitch period, gain information, and the like or input speech signal). In this case, the excitation signal may remain the same before and after modification depending on conditions.

The present invention can be applied to an electronic apparatus designed to perform digital speech processing, e.g., a handyphone, portable terminal, or personal computer with speech processing.

According to the present invention, there is provided an electronic apparatus comprising a speech encoder which executes the above speech encoding method, and a speech input device (a direct speech input device such as a microphone or an input device which inputs a speech signal that is externally supplied) for supplying a speech signal to the speech encoder.

In addition, according to the present invention, there is provided an electronic apparatus comprising a speech decoder which executes the above speech decoding method for the speech signal encoded by the above speech encoding method, and a speech output device (a direct sound device such as a loudspeaker or a speech supply device which supplies a speech signal to an external apparatus) for outputting a speech signal from the speech decoder.

If an electronic apparatus includes both an encoder and a decoder, the apparatus can encode and decode speech signals. If, however, decoding is not required, the apparatus may include only an encoder together with another means necessary therefor. If only decoding is required, the apparatus may include only a decoder together with another means necessary therefor.

A handyphone requires both an encoding function and a decoding function because it transmits/receives signals to/from a remote apparatus.

In base stations and relay stations constituting a telephone network, analog and digital lines must be connected to each other in some cases. In such cases as well, since encoded speech signals are supplied from the digital line side, and analog speech signals before encoding are supplied from the analog line side, encoding and decoding must be performed for the respective operations. Therefore, both an encoding function and a decoding function are required. The present invention can also be applied to an electronic apparatus designed to receive a speech signal from an external apparatus and return the signal to the external apparatus or transfer it to another apparatus upon encoding it.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described with reference to the views of the accompanying drawing.

Figure 1:
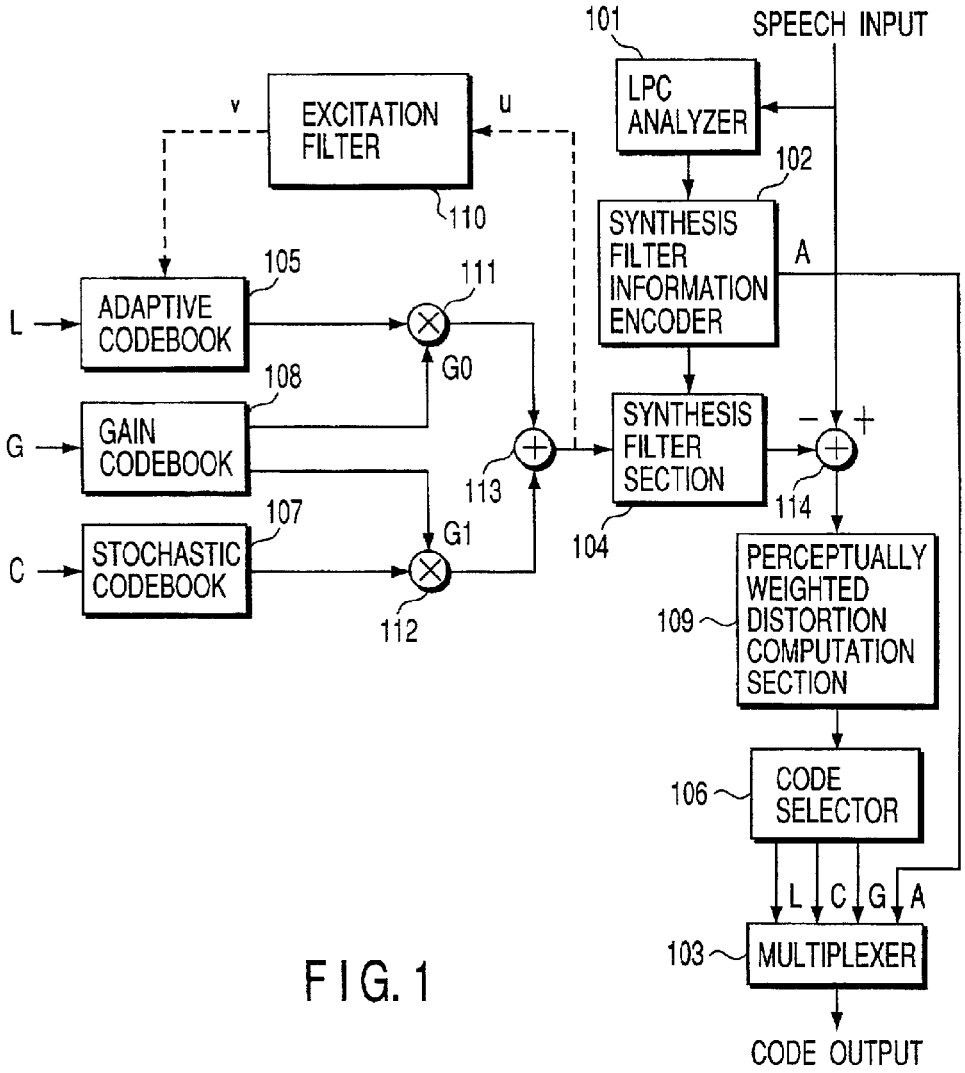
FIG. 1 is a block diagram showing speech encoding according to an embodiment of the present invention.

FIG. 1 is a schematic block diagram showing a speech encoding method in this embodiment of the present invention. An input speech signal input from a speech input device (not shown) such as a microphone is A/D-converted and processed in units of frames each corresponding to a predetermined period of time. An LPC analyzer 101 analyzes the framed input speech signal to extract linear predictive coefficients (LPC coefficients). A synthesis filter information encoder 102 encodes the extracted LPC coefficients and outputs synthesis filter information A to a multiplexer 103. The linear predictive coefficients are used as synthesis filter coefficients ($\alpha(i)$: the order of a filter is set to, for example, 10, as needed) of a synthesis filter section 104. Subsequently, for example, each frame is divided into subframes corresponding to predetermined time intervals to obtain pitch period information L, stochastic code C, and gain information G. An adaptive codebook 105 stores past excitation signals (past excitation signals modified by filter processing in the present invention). Upon reception of a pitch period as a candidate, the adaptive codebook 105 retraces by a length corresponding to the pitch period and extracts an excitation signal. The adaptive codebook 105 generates an adaptive code vector by repeating this signal.

In searching for a pitch period, a perceptually weighted distortion computation section 109 calculates the waveform distortion caused when the synthesis filter section 104 synthesizes an adaptive code vector corresponding to a pitch period candidate, and a code selector 106 searches for a pitch period in which the distortion of the perceptually weighted synthesized waveform is reduced more. Although the value obtained by open loop pitch analysis on a frame basis can be used as the initial value of a candidate pitch, the present invention is not limited to this.

The pitch period determined by the adaptive codebook search is converted into the pitch period information L and output to the multiplexer 103.

A stochastic codebook 107 outputs a stochastic vector corresponding to the supplied stochastic code as a stochastic code vector candidate. In some scheme, a stochastic codebook is structured so as not to directly store stochastic code vectors. For example, a scheme using an Algebraic codebook is available. This Algebraic codebook is designed to express a code vector by a combination of pulse position information and polarity information with the amplitudes of a predetermined number of pulses being limited to +1 and −1. According to characteristic features of the Algebraic codebook, a codebook can be expressed by a small memory capacity because any code vectors themselves need not be stored, and stochastic components contained in excitation information can be expressed with relatively high quality in spite of a small calculation amount required for code vector selection.

A scheme using an Algebraic codebook to encode excitation signals is called an ACELP scheme or ACELP-based scheme and known as a scheme of obtaining a synthesized speech with little distortion.

In searching for the stochastic code C, the perceptually weighted distortion computation section 109 computes the perceptually weighted distortion contained in the waveform formed when a stochastic code vector corresponding to a stochastic code candidate is synthesized by the synthesis filter section 104, and the code selector 106 searches for a stochastic code with which the distortion of this perceptually weighted synthesized waveform is reduced more. The found stochastic code C is output to the multiplexer 103.

In this embodiment, the expression "stochastic codebook" is used. Obviously, however, a stochastic code vector expressed by this codebook need not always be stochastic. For example, this code vector may be a pulse excitation code vector as in an Algebraic codebook.

A gain codebook 108 stores candidates for a gain G0 used for an adaptive code vector and a gain G1 used for a stochastic code vector. For example, in searching for a gain code, the perceptually weighted distortion computation section 109 computes the perceptually weighted distortion contained in the waveform formed when the excitation code vector obtained by adding the adaptive code vector and stochastic code vector multiplied by gain candidates, respectively, is synthesized by the synthesis filter. The code selector 106 searches for a gain code with which the distortion of the perceptually weighted synthesized waveform is reduced more.

The found gain code G is output to the multiplexer 103. Various methods can be used to determine the above pitch period information L, stochastic code C, and gain information G. For example, the following method can be used.

The pitch period information L is obtained by an adaptive codebook search (adaptive code vector). The stochastic code C (stochastic code vector) is then obtained by making a stochastic codebook search so as to reduce the difference between the target vector and the vector obtained by multiplying the obtained adaptive code vector by a temporary gain (e.g., optimal gain). The gain information G (gain code vector) is obtained by making a gain codebook search using the obtained adaptive code vector and stochastic code vector.

Apparently, the present invention is not limited to the above method. By using the pitch period information L, stochastic code C, and gain information G found in this manner, an excitation signal (excitation vector) u is generated according to equation (1):

$$u=G0\times 0+G1\times 1 \tag{1}$$

where x0 is the adaptive code vector obtained from the adaptive codebook 105 in correspondence with the pitch period information L, x1 is the stochastic code vector obtained from the stochastic codebook 107 in correspondence with the stochastic code C, G0 is a gain which is obtained from the gain codebook 108 in correspondence with the gain information G and multiplied with the adaptive code vector in a multiplier 111, and G1 is a gain which is obtained from the gain codebook 108 in correspondence with the gain information G and multiplied with the stochastic code vector in a multiplier 112. The outputs of the multipliers 111 and 112 are added by an adder 113.

The synthesis filter section 104 generates a synthesized speech by performing synthesis filtering expressed as $1/A(z)$:$A(z)=1+\Sigma\alpha(i)z^{-i}$ where $\alpha(i)$ is a synthesis filter coefficient (synthesis filter information A) in a z-transform domain with respect to the input of the excitation signal u obtained in this manner. This synthesized speech and input speech are subtracted from each other in an adder 114, and the above various selection/determination steps are then performed to reduce the difference, i.e., the distortion of the perceptually weighted synthesized waveform calculated by the perceptually weighted distortion computation section 109.

The obtained excitation vector u is modified (or corrected) by the excitation filter 110 and stored in the adaptive codebook 105. Various methods can be used for this modification (or correction). For example, the vector can be modified by directly filtering it using an excitation filter having predetermined characteristics. As this excitation filter, for example, a single-order recursive filter expressed by equation (2) given below can be used:

$$R(z)=1/(1-klz^{-1}) \quad (2)$$

where k1 is a filter coefficient.

When an excitation filter having such output characteristics is used, an excitation signal v(n) after modification can be given by $$v(n)=u(n)+klv(n-1) \quad (3)$$

where u(n) is the excitation signal before modification, v(n) is the excitation signal after modification (n=0, . . . , N−1, where N is the order of an excitation vector), and k1 is a filter coefficient.

Figure 2:
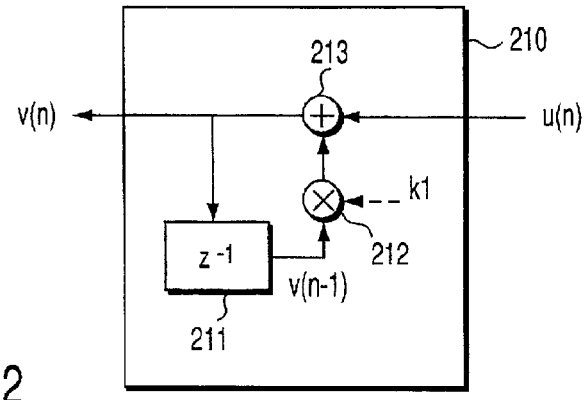
FIG. 2 is a block diagram showing an excitation filter according to the embodiment of the present invention.

FIG. 2 schematically shows processing by this excitation filter. The input excitation signal u(n) is input to an excitation filter 210 including a delay device 211, multiplier 212, and adder 213. In the excitation filter 210, the multiplier 212 multiplies a signal v(n−1), obtained by delaying the output signal v(n) from the excitation filter using the delay device 211, by the filter coefficient k1, and the adder 213 then adds the excitation signal u(n) to the product, thereby outputting the resultant signal as the modified excitation signal v(n).

Figure 3:
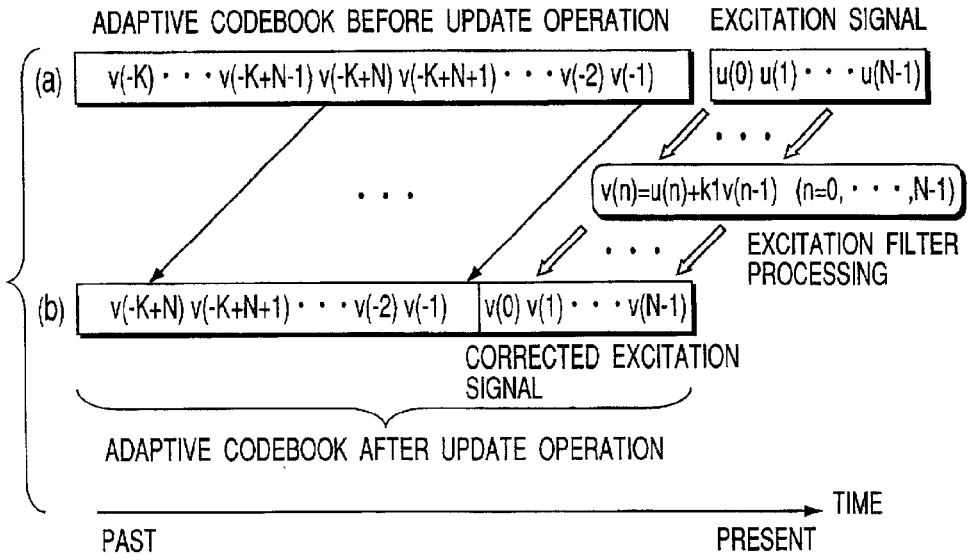
FIG. 3 is a view for explaining an adaptive codebook according to the embodiment of the present invention.

As described above, since a better effect can be obtained by increasing the degree of contribution in a low frequency band, a better effect can be obtained by providing low-pass characteristics. According to experiments, a value satisfying 0<k1<0.25 or the like is preferably used. The excitation signal v(n) modified in this manner is stored as latest information in the adaptive codebook. The adaptive codebook is updated by being shifted by N samples as a whole so as to discard the oldest excitation signal data and store the latest excitation signal data. The latest data is added in this manner. FIG. 3 is a schematic view showing this state. The adaptive codebook before update operation is made up of v(−K)v(−K+1), . . . , v(−K+N−1)v(−K+N)v(−K+ N+1), . . . , v(−2)v(−1), where N is the number of excitation vectors and K is the number of excitation signal data stored in the adaptive codebook. The oldest excitation signal is v(−K)v (−K+1), . . . , v(−K+N−1), which is discarded. The data "v(0)v(1), . . . , V(N−1)" obtained from the latest excitation signal "u(0)u(1), . . . , u(N−1)" before modification by excitation filtering [v(n)=u(n)+*klv*(n−1):(n=0, . . . , N−1)] is stored in the adaptive codebook as the latest data.

The synthesis filter information A, pitch period information L, stochastic code C, and gain information G obtained by the above encoding method are multiplexed, and the multiplexed encoded output is sent out.

Figure 4:
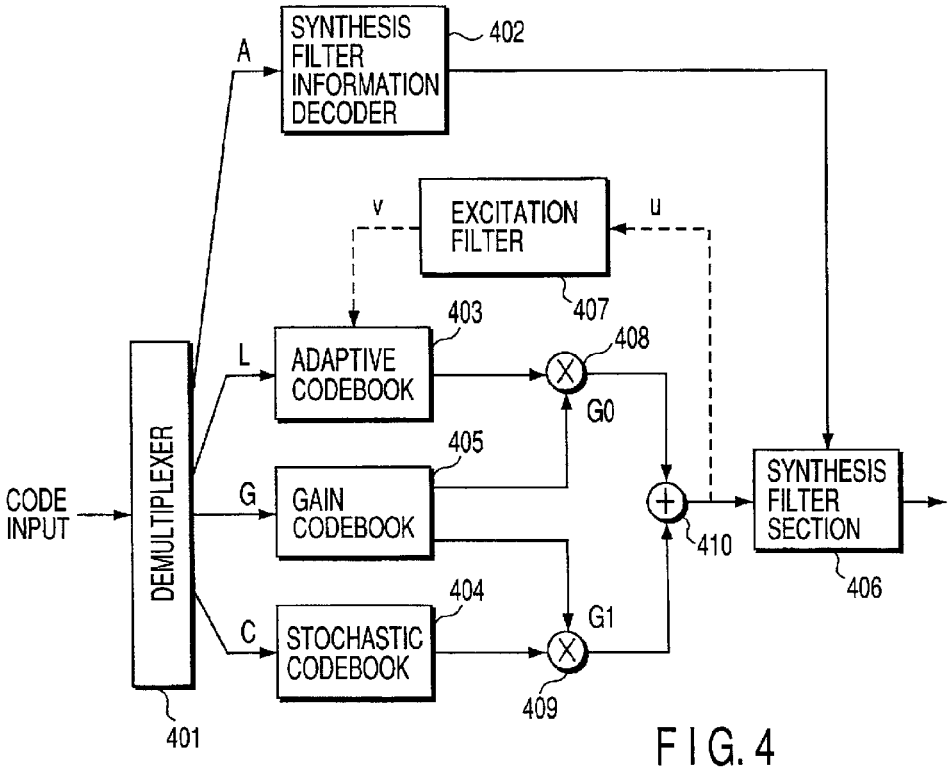
FIG. 4 is a block diagram showing speech decoding according to the embodiment of the present invention.

Decoding to be performed upon reception of this encoded information will be described below with reference to FIG. 4. A demultiplexer 401 demlutiplexes the encoded input to obtain the synthesis filter information A, linear predictive pitch period information L, stochastic code C, and gain information G. These pieces of information are respectively sent out to a synthesis filter information decoder 402, adaptive codebook 403, stochastic codebook 404, and gain codebook 405.

The synthesis filter information decoder 402 obtains a linear predictive coefficient (LPC) on the basis of the obtained synthesis filter information A, reconstructs the same LPC coefficient as that on the encoding side, and sends out the LPC coefficient to a synthesis filter section 406. The adaptive codebook 403 stores past excitation signals like the codebook on the encoding side. The adaptive codebook 403 retraces from the latest signal by a length corresponding to the pitch period L and extracts an excitation signal. The adaptive codebook 403 generate an adaptive code vector by repeating this signal.

The stochastic codebook 404 outputs a stochastic code vector corresponding to the stochastic code C on the basis of the code C. The gain codebook 405 outputs the gain G0 for an adaptive code vector and the gain G1 for a stochastic code vector on the basis of the gain code G.

The adaptive code vector obtained in the above manner is multiplied by the gain G0 in a multiplier 408, and the stochastic code vector is multiplied by the gain G1 in a multiplier 409. These vectors are then added by an adder 410, and the resultant signal is input as the excitation signal u to a synthesis filter section 406. This operation is equivalent to equation 1 in encoding operation. The synthesis filter section 406 performs synthesis filter processing represented by 1/A(z) for the input of the excitation signal vector (vector obtained by multiplying the respective vectors by gains) based on the adaptive code vector and stochastic code vector in the same manner as on the encoding side, thereby generating a synthesized speech.

Note that an excitation signal v modified by an excitation filter 407 on the basis of the generated excitation signal u is stored as latest data in the adaptive codebook as in encoding operation. That is, the adaptive codebook having identical information to that on the encoding side is also held on the decoding side. By storing the excitation signal modified by the excitation filter in the adaptive codebook on the decoding side as well, a speech signal with little perceptual distortion, obtained on the encoding side, can be faithfully reproduced.

Figure 5:
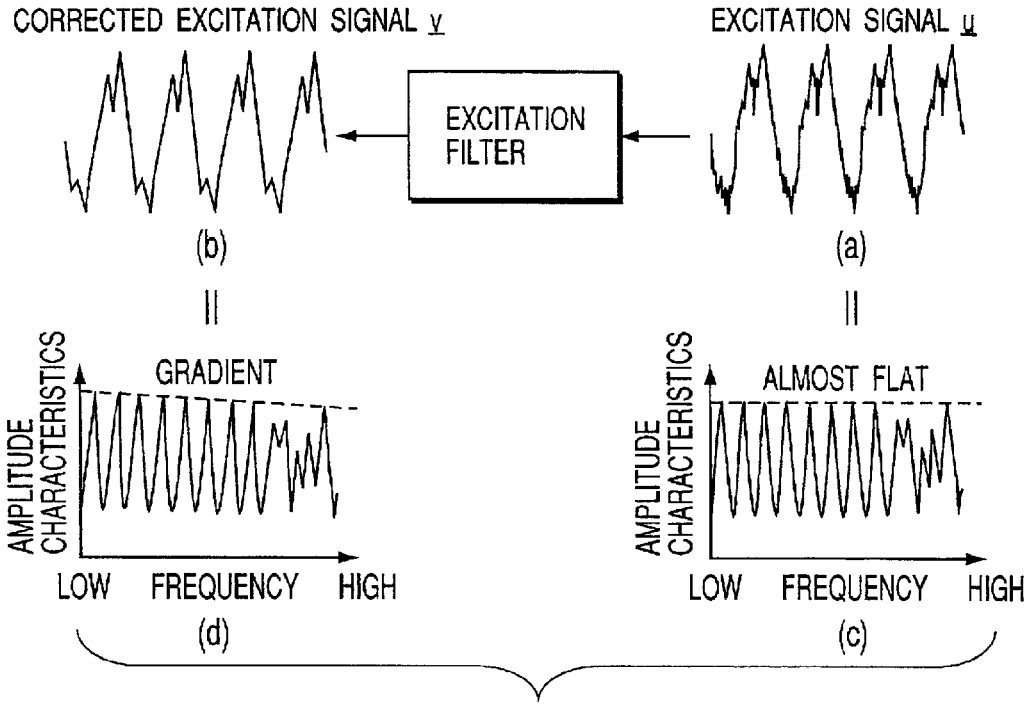
FIG. 5 is a view for explaining the function of the excitation filter according to the embodiment of the present invention.

The functional role of the excitation filter in encoding/decoding operation of the present invention will be described with reference to FIG. 5. Referring to FIG. 5, reference symbol (a) denotes the time waveform of an excitation signal before modification; (b), the time waveform of an excitation signal after modification using an excitation filter; and (c) and (d), amplitude characteristics of the excitation signal (a) and modified excitation signal (b) on the frequency axis.

As indicated by the dashed line, the frequency amplitude of the excitation signal u before modification using an excitation filter is almost flat without any tilt on average. In contrast to this, the frequency amplitude of the excitation signal v modified by the excitation filter 110 is not flat on average but has a tilt, exhibiting a higher amplitude in a low-frequency region. This indicates that the frequency characteristics of the excitation filter are equivalent to those represented by the dashed line indicated by "(d)" in FIG. 5. In general, this filter has low-pass characteristics.

As described above, an adaptive code vector contributes more to better expression of an excitation source in a low-frequency region, and hence an excitation filter having such characteristics is preferably used to realize high quality. In addition, the power of an excitation signal having passed through the filter preferably remains the same. In this case, an excitation filter may be formed as follows:

$$R(z)=b0/(1-blz^{-1})$$

where B0 and b1 are filter coefficients. Note that b0+b1=1.

By using an excitation filter having such output characteristics, the excitation signal v(n) after modification can be expressed by $$v(n)=0u(n)+blv(n-1)$$

Figure 6:
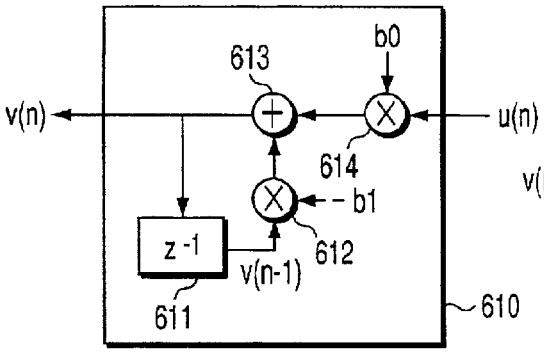
FIG. 6 is a block diagram showing an excitation filter according to the embodiment of the present invention.

FIG. 6 schematically shows processing by this excitation filter. An excitation filter 610 includes a delay section 611, first multiplier 612, adder 613, and second multiplier 614. The delay section 611 delays the output signal v(n) from the excitation filter by one sampling cycle to obtain a signal v(n−1). The first multiplier 612 then multiplies the signal v(n−1) by the filter coefficient b1. The adder 613 adds the resultant signal to the signal obtained by multiplying the excitation signal u(n) by the filter coefficient b0 using the second multiplier 614, and outputs the resultant signal as the modified excitation signal v(n). In this case as well, a value satisfying 0<b1<0.25 or the like is preferably set to realize low-pass characteristics.

The excitation filter to be used is not limited to the above recursive filter, and the present invention can use a non-recursive filter like the one expressed by $$R(z)=1+k2z^{-1}$$

where k2 is a filter coefficient.

In this case, an excitation signal v(n) after modification which is obtained by inputting the excitation signal u to the excitation filter is given by $$v(n)=u(n)+k2u(n-1)$$

Figure 7:
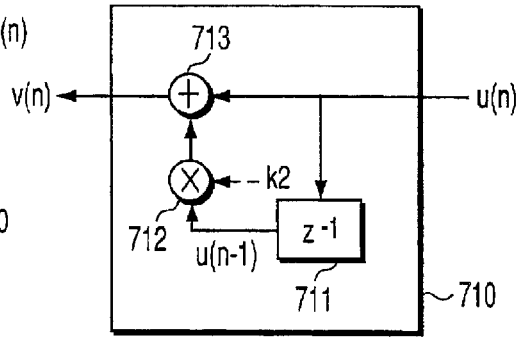
FIG. 7 is a block diagram showing an excitation filter according to the embodiment of the present invention.

FIG. 7 schematically shows processing by this excitation filter.

An excitation filter 710 includes a delay section 711, multiplier 712, and adder 713. The delay section 711 delays the excitation signal v(n) by one sampling cycle to obtain a signal u(n−1). The first multiplier 712 then multiplies the signal u(n−1) by a filter coefficient k2. The adder 713 adds the excitation signal u(n) to the resultant signal, and outputs the resultant signal as the modified excitation signal v(n).

As described above, since a better effect can be obtained by increasing the degree of contribution in a low frequency band, a better effect can be obtained by providing low-pass characteristics. According to experiments, a value satisfying 0<k2<0.25 or the like is preferably set. In this case as well, the gain of the excitation filter can be adjusted. In this case, the following excitation filter may be used:

$$R(z)=c0+clz^{-1}$$

where c0 and c1 are filter coefficients.

In this case, the excitation signal v(n) after modification which is obtained by inputting the excitation signal u to the excitation filter is given by $$v(n)=c0u(n)+clu(n-1)$$

The gain of the excitation filter can be set to 1 by setting c0+c1=1. In this case as well, as described above, since a better effect can be obtained by increasing the degree of contribution in a low frequency band, a better effect can be obtained by providing low-pass characteristics for the excitation filter. A value satisfying 0<(c1/c0)<0.25 or the like is preferably set.

Figure 8:
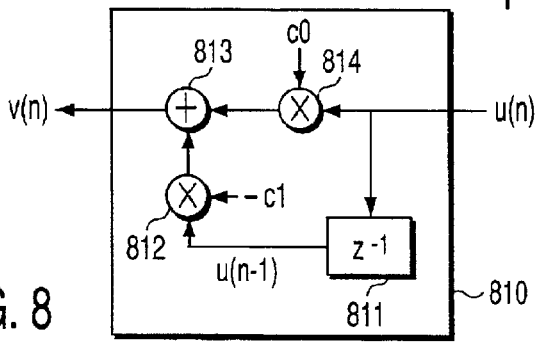
FIG. 8 is a block diagram showing an excitation filter according to the embodiment of the present invention.

FIG. 8 schematically shows processing by this excitation filter. An excitation filter 810 includes a delay section 811, first multiplier 812, adder 813, and second multiplier 814. The delay section 811 delays the excitation signal v(n) by one sampling cycle to obtain the signal u(n−1). The first multiplier 812 multiplies the signal u(n−1) by a filter coefficient c1. The adder 813 then adds the resultant signal to the signal obtained by multiplying the excitation signal u(n) by a filter coefficient c0 using the second multiplier 814, and outputs the resultant signal as the modified excitation signal v(n).

The excitation filter need not have fixed characteristics. A plurality of excitation filters having different characteristics may be selectively used, or an excitation filter having variable characteristics, e.g., an excitation filter capable of varying the value of the filter coefficient(s) may be used. Note that information transfer must be performed to allow the use of excitation filters having the same characteristics on the encoding and decoding sides.

For example, a method of changing the filter characteristics of an excitation filter by using the encoded information of a speech signal is available. A mechanism of making the filter characteristics of the excitation filter shown in FIG. 1 adaptive on the basis of present or past encoded information (A, L, G, and the like) can be used. In this case, a filter characteristic R(f(y), z): f(y) of the excitation filter is a function of a variable y, and y can be expressed as present or past encoded information. Alternatively, excitation filters can be switched by selecting one set of excitation filter coefficients from a plurality of sets of excitation filter coefficients.

By switching the characteristics of an excitation filter on the basis of the encoded information of speech, an excitation filter can be adaptively used in accordance with the features of a speech signal. In addition, there is no need to send additional information required to switch excitation filters.

An excitation signal used to generate a synthesized speech may be preferably stored in the adaptive codebook without any modification depending on conditions. For this reason, switching of excitation filters or changing of filter characteristics is preferably selected in consideration of the above case as well, in which no excitation filtering is performed. The present invention is not limited to those described above, and various excitation filters can be used. By updating the adaptive codebook with excitation signals having undergone modification by the excitation filter, an adaptive codebook that places emphasis on a portion exhibiting great contribution to an excitation signal can be obtained.

Synthesized speech can be obtained, which has high quality as compared with a case where an adaptive codebook storing excitation signals without any changes is used.

As has been described above, according to the present invention, a speech encoding/decoding method capable of obtaining a synthesized speech with high quality can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech encoding method comprising:

adding a first signal from an adaptive codebook, which stores a past low-pass filtered excitation signal, and a second signal from a second codebook to generate an excitation signal;

generating a synthesized speech signal using the excitation signal;

filtering the excitation signal through a short-term excitation filter having low-pass characteristics to produce a low-pass filtered excitation signal; and storing the low-pass filtered excitation signal in the adaptive codebook.

2. A method according to claim 1, wherein the second codebook is a stochastic codebook.

3. A method according to claim 1, wherein the filtering step is performed by a recursive filter expressed by $R(z)=1/(1-k1z^{-1})$ (k1: filter coefficient) in a z-transform domain.

4. An electronic apparatus comprising:

a speech encoder configured to execute the speech encoding method according to claim 1; and a speech input device configured to supply a speech signal to the speech encoder.

5. An electronic device comprising:

a speech encoder configured to execute the speech encoding method according to claim 1;

a speech decoder configured to execute a speech decoding method comprising:

adding a first signal from an adaptive codebook, which stores a past low-pass filtered excitation signal, and a second signal from a second codebook to generate an excitation signal;

generating a synthesized speech signal using the excitation signal;

filtering the excitation signal through a short-term excitation filter having low-pass characteristics to produce a low-pass filtered excitation signal; and storing the low-pass filtered excitation signal in the adaptive codebook.

6. A speech encoding method comprising:

selecting code information representing a first code vector by using an adaptive codebook so as to reduce perceptually weighted distortion between a target vector obtained from an input speech signal and a synthesized vector;

selecting code information representing a second code vector from a second codebook so as to reduce perceptually weighted distortion of a synthesized speech signal;

adding a first signal from the first code vector and a second signal from the second code vector to generate an excitation signal;

generating a synthesized speech signal using the excitation signal;

filtering the excitation signal through a short-term excitation filter having low-pass characteristics to produce a low-pass filtered excitation signal; and storing the low-pass filtered excitation signal in the adaptive codebook.

7. A method according to claim 6, wherein the filtering step is performed by a recursive filter expressed by $R(z)=1/(1-k1z^{-1})$ (k1: filter coefficient) in a z-transform domain.

8. A speech decoding method comprising:

adding a first signal from an adaptive codebook, which stores a past low-pass filtered excitation signal, and a second signal from a second codebook to generate an excitation signal;

generating a synthesized speech signal using the excitation signal;

filtering the excitation signal through a short-term excitation filter having low-pass characteristics to produce a low-pass filtered excitation signal; and storing the low-pass filtered excitation signal in the adaptive codebook.

9. A method according to claim 8, wherein the second codebook is a stochastic codebook.

10. A method according to claim 8, wherein the filtering step is performed by a recursive filter expressed by $R(z)=1/(1-k1z^{-1})$ (k1: filter coefficient) in a z-transform domain.

11. An electronic apparatus comprising:

a speech decoder configured to execute the speech decoding method according to claim 8; and a speech output device configured to output a speech signal from the speech decoder.

12. A speech encoding apparatus comprising:

an adaptive codebook configured to store a past low-pass filtered excitation signal;

a second codebook configured to generate a second signal;

an adder configured to add a first signal from the adaptive codebook and a second signal from the second codebook to generate an excitation signal;

a synthesis filter configured to generate a synthesized speech signal using the excitation signal; and a short-term excitation filter having low-pass characteristics configured to filter the excitation signal and produce a low-pass filtered excitation signal to be stored in the adaptive codebook.

13. An electronic apparatus comprising:

a speech encoding apparatus according to claim 12; and a speech input device configured to supply a speech signal to the speech encoding apparatus.

14. An electronic device comprising:

a speech encoding apparatus according to claim 12;

a speech decoding apparatus comprising:

an adaptive codebook configured to store a past low-pass filtered excitation signal and configured to generate a first signal;

a second codebook configured to generate a second signal;

an adder configured to add the first signal and the second signal to generate an excitation signal;

a synthesis filter configured to generate a synthesized speech signal using the excitation signal;

a short-term excitation filter having low-pass characteristics configured to filter the excitation signal and produce a low-pass filtered excitation signal to be stored in the adaptive codebook;

a speech input device configured to supply a speech signal to the speech encoding apparatus; and a speech output device configured to output a speech signal from the speech decoding apparatus.

15. A speech encoding apparatus according to claim 12, wherein the first signal is an adaptive code vector multiplied by a gain; and the second codebook is a stochastic codebook.

16. A speech encoding apparatus comprising:

a first codebook configured to store a past modified low-pass filtered excitation signal and generate a first code vector;

a second codebook configured to generate a second code vector;

a first code vector selector configured to select a code vector representing the first code vector from the first codebook so as to reduce perceptually weighted distortion between a target vector obtained from an input speech signal and a synthesized vector obtained from a candidate vector of the first code vector;

a second code vector selector configured to select a code vector representing the second code vector from the second codebook so as to reduce perceptually weighted distortion of a synthesized speech signal;

an adder configured to add a first signal from the selected first code vector and a second signal from the selected second code vectors to generate an excitation signal;

a synthesis filter configured to generate a synthesized speech signal using the excitation signal; and a short-term excitation filter having low-pass characteristics configured to filter the excitation signal and produce a low-pass filtered excitation signal to be stored in the adaptive codebook.

17. A speech decoding apparatus comprising:

an adaptive codebook configured to store a past low-pass filtered excitation signal and configured to generate a first signal;

a second codebook configured to generate a second signal;

an adder configured to add the first signal and the second signal to generate an excitation signal;

a synthesis filter configured to generate a synthesized speech signal using the excitation signal; and a short-term excitation filter having low-pass characteristics configured to filter the excitation signal and produce a low-pass filtered excitation signal to be stored in the adaptive codebook.

18. An electronic apparatus comprising:

a speech decoding apparatus according to claim 17; and a speech output device configured to output a speech signal from the speech decoding apparatus.

* * * * *

UNITED STATES PATENT AND TRADEMARK OFFICE

CERTIFICATE OF CORRECTION

PATENT NO. : 6,842,732 B2
DATED : January 11, 2005
INVENTOR(S) : Miseki

It is certified that error appears in the above-identified patent and that said Letters Patent is hereby corrected as shown below:

Column 12,
Line 48, delete "modified".

Signed and Sealed this

Twelfth Day of April, 2005

JON W. DUDAS
*Director of the United States Patent and Trademark Office*